United States Patent [19]

Auer et al.

[11] 3,982,687

[45] Sept. 28, 1976

[54] CLOSE AND CARRY BAG

[75] Inventors: Mary L. Auer, Neenah; Richard L. Roeder, Appleton, both of Wis.

[73] Assignee: Kimberly-Clark Corporation, Neenah, Wis.

[22] Filed: July 9, 1975

[21] Appl. No.: 594,451

[52] U.S. Cl. ..... 229/62; 150/11; 229/54 R

[51] Int. Cl.[2] ..... B65D 33/24; B65D 33/28

[58] Field of Search ..... 229/62, 63, 54 R, 54 C, 229/66; 150/11, 12

[56] References Cited

UNITED STATES PATENTS

| | | | |
|---|---|---|---|
| 2,920,670 | 1/1960 | Mohlmann | 150/12 |
| 3,285,309 | 11/1966 | Northcott | 150/11 |
| 3,480,198 | 11/1969 | Repko | 229/62 |
| 3,512,700 | 5/1970 | Evans et al. | 229/62 |
| 3,679,126 | 7/1972 | Lake | 229/62 |
| 3,716,182 | 2/1973 | Korn | 150/11 |
| 3,738,567 | 6/1973 | Ruda | 229/62 |
| 3,746,066 | 7/1973 | McIntyre | 150/11 |
| 3,752,388 | 8/1973 | Lynch | 229/54 R |
| 3,865,303 | 2/1975 | Korn | 229/62 |
| 3,889,872 | 6/1975 | Lin | 229/63 |

FOREIGN PATENTS OR APPLICATIONS

| | | | |
|---|---|---|---|
| 949,658 | 2/1964 | United Kingdom | 229/63 |

*Primary Examiner*—William Price
*Assistant Examiner*—Bruce H. Bernstein
*Attorney, Agent, or Firm*—Daniel J. Hanlon, Jr.; William D. Herrick; Raymond J. Miller

[57] ABSTRACT

A bag formed of heat-sealable material and having a strap attached so as to extend substantially across one side dimension with means for forming apertures to project the strap through the bag side walls to close the bag and provide a carrying handle. Disclosed embodiments include bottom loading and top loading versions of the improved bag as well as preferred constructions of the strap and the means for projecting the strap through the bag sidewalls. The bag can be used as a container for marketing goods in a sealed condition and, when open, can be reclosed by means of the strap resulting in a handy receptacle for a wide variety of uses.

7 Claims, 12 Drawing Figures

CLOSE AND CARRY BAG

BACKGROUND OF THE INVENTION

1. Field of the Invention

This invention pertains generally to bags having a strap-like grip or handle for convenience in carrying. More particularly, it relates to such bags that are reusable and may be closed by means of the handle. These bags may be inexpensively manufactured from heat-sealable materials, and, when used for the merchandising of goods, provide convenience for the consumer and an added incentive to purchase the goods contained therein.

2. Description of the Prior Art

Department stores and the like have long recognized that consumers appreciate the convenience of market bags having a handle. For years, bags constructed of paper with simple handles attached have been dispensed free or sold at a nominal price to aid the burdened shopper. More recently, it has become a relatively common practice for manufacturers to market their goods self-contained in such bags or similar ones made of plastic materials. Particularly when these bags are reusable, they provide not only convenience for the consumer in toting the goods but an added incentive to purchase by virtue of the many uses to which the bag can subsequently be put around the home. This is especially true when the bag is constructed so that it can be reclosed after its initial contents have been removed.

Bags reclosable by means of drawstrings have been available for some years. Examples of these are described in Schoen U.S. Pat. No. 3,119,549 issued Jan. 28, 1964, Ashton U.S. Pat. No. 3,228,584 issued Jan. 11, 1966, Mueller U.S. Pat. No. 3,226,009 issued Dec. 28, 1965, Kugler U.S. Pat. No. 3,093,295 issued June 11, 1963, and others. However, the manufacture of such bags is relatively expensive due to the complexity of the structure and the machinery required to produce it. It is apparent, therefore, that the added expense relating to the use of such bags may necessitate a price increase for the goods that, except for luxury items where the cost of the bag represents a very small fraction of the total purchase price, in large part overcomes the incentive for the purchaser resulting from the convenience of the bag.

Other more complicated bag structures have been proposed such as those disclosed in Steen U.S. Pat. No. 2,854,185 issued Sept. 30, 1958, Honsel U.S. Pat. No. 3,610,517 issued Oct. 5, 1971, Haugh et al. U.S. Pat. No. 3,370,630 is ed Feb. 27, 1968, and Membrino U.S. Pat. No. 3,[illegible]40 420 issued Mar. 15, 1966, but such bags have not provided the handy reclosability obtainable by means of the more expensive drawstring type.

SUMMARY OF THE INVENTION

The present invention provides a bag which is inexpensive to produce and yet is reclosable in the manner of earlier drawstring bags. The bag of the invention is manufactured from heat-sealable material and provided with a strap extending laterally across one side face dimension near the top end of the bag. The bag further includes aperture forming means for projecting this strap through the side walls of the bag to close the top and provide a carrying handle. The strap is also made of heat-sealable material which may be the same material of which the remainder of the bag is formed. The means for projecting the strap through the sidewalls may simply be an aperture, or, where contents are to be sealed, corresponding weakened areas in the bag sidewalls which may be punched out to form apertures.

The improved bag may be formed as a top loading or bottom loading structure with or without gussets. It may also include additional features such as reinforcement of the apertures and an extension of one sidewall with a corresponding aperture to form an overlap cover.

DESCRIPTION OF THE PREFERRED EMBODIMENTS

While the invention will be described in connection with preferred embodiments, it will be understood that it is not intended to limit the invention to those embodiments. On the contrary, it is intended to cover all alternatives, modifications and equivalents as may be included within the spirit and scope of the invention as defined by the appended claims.

Figure 1:
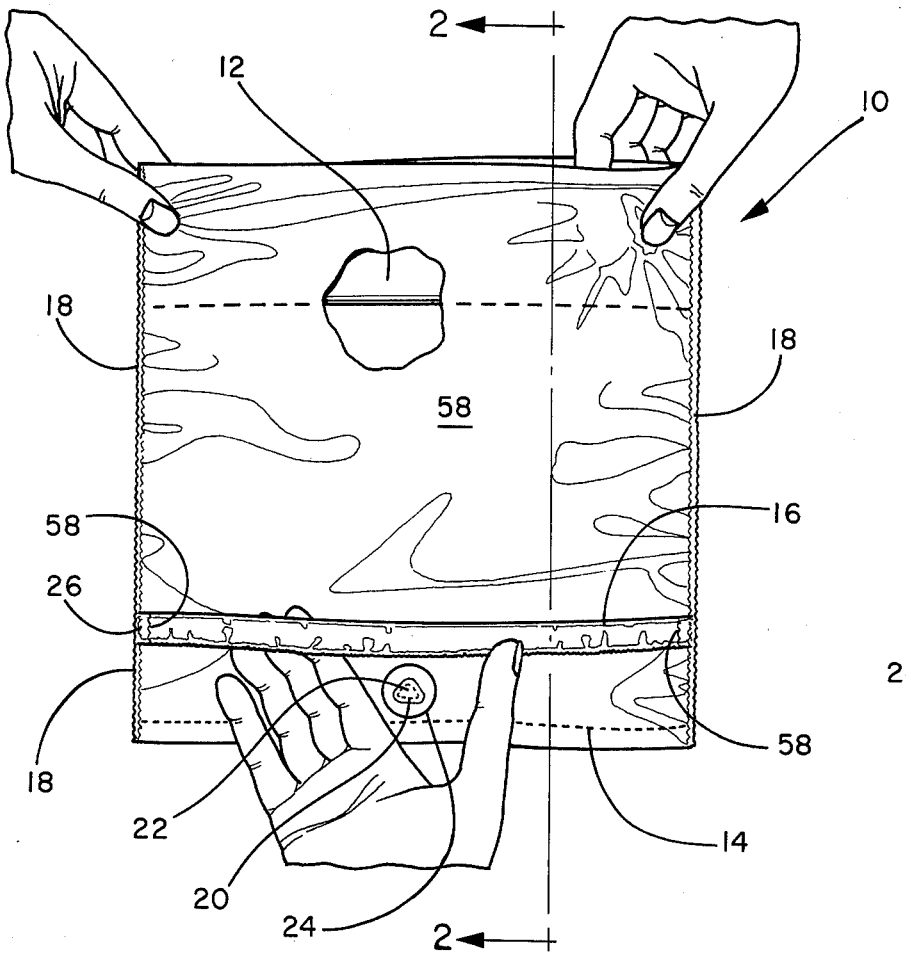
FIG. 1 is a view of a bag constructed in accordance with the invention.

Turning to FIG. 1, there is shown bag 10 which is formed from heat-sealable thermoplastic material. Such materials include, by way of example and not limitation, polyolefins such as polyethylene and polypropylene, polyesters, vinyl polymers, and the like. The thickness of the film will depend upon the particular polymer selected as well as the intended contents for the bag. However, generally the thickness will be in the range of from about 1 to 3 mils.

Figure 2:
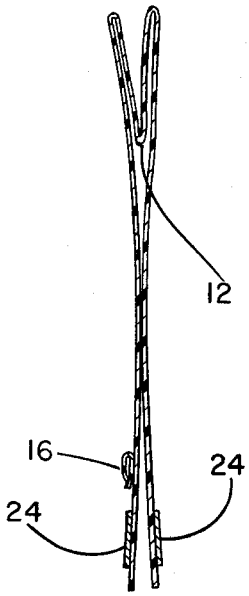
FIG. 2 is a cross-section of the bag of FIG. 1 taken along lines 2—2.

The bag illustrated includes bottom gusset 12 (FIG. 2) and is closed at the top in a manner that it can be easily opened by perforation 14 in both faces or panels of the bag. It is intended for top loading of the bag contents.

Figure 3:
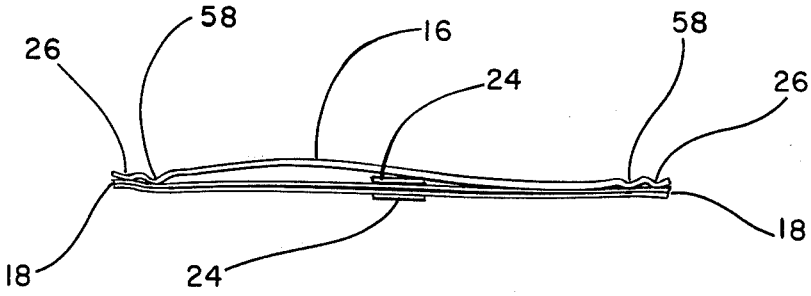
FIG. 3 is a top end view of the bag of FIG. 1.

In accordance with the invention strap 16 extends laterally generally parallel to the bag bottom substantially across one full side dimension of panel 58 and is formed of material that is heat-sealable and bonded to edges 18 of bag 10. For additional security the strap may be further secured to the side wall as by means of additional bar seals 58 located adjacent the side seams. The strap material may be the same material as that used for bag 10, but it is preferably of multiple thicknesses or heavier gauge (FIG. 2) for increased strength. For closing the bag after it has been initially opened by means of perforation 14, triangular perforations 20 are provided on both panels of bag 10 such that, when perforated areas 22 are removed, apertures are provided through which strap 16 may be projected. Preferably, reinforcement 24 is provided around triangular perforation 20 for tear resistance. Of course, the shape of the aperture and its reinforcement are primarily matters of choice, and the triangular illustration is by way of example only. The reinforcement may be applied by means of heat-sealing, adhesives, or the like and may be made from paper, plastic, or the like. As is shown more clearly in FIG. 3, strap 16 in this embodiment is attached to the bag only at heat-sealed edges 26 and adjacent bar seals 58.

Figure 4:
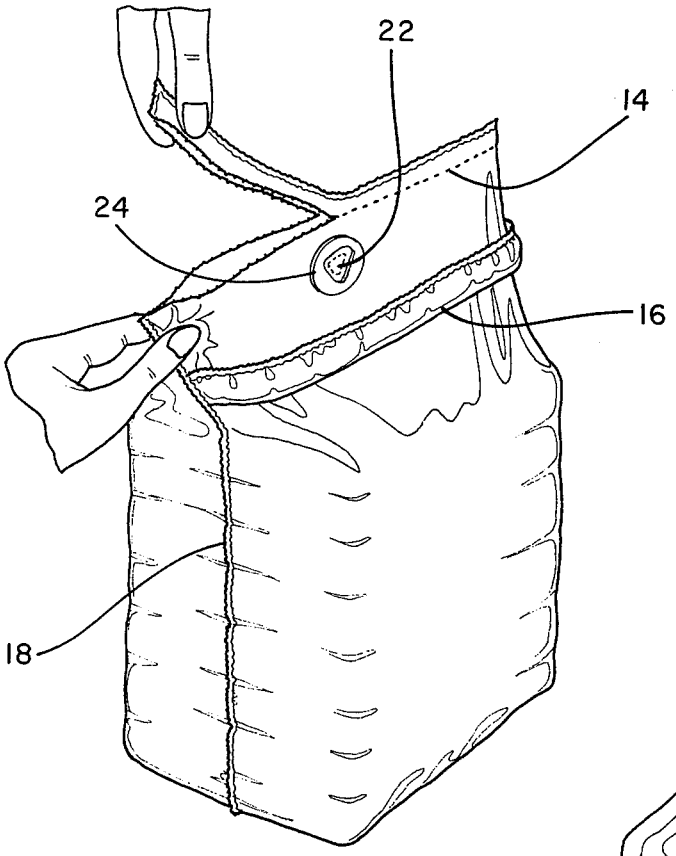
FIGS. 4, 5 and 6 illustrate a loaded bag of the invention being opened and reclosed.
Figure 5:
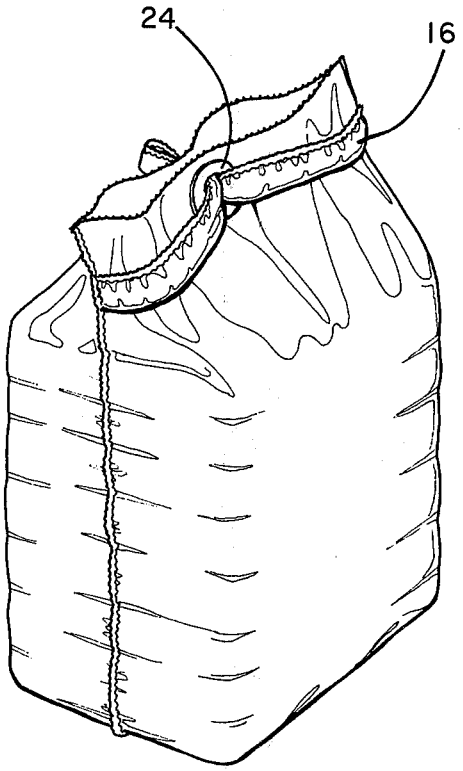
Figure 6:
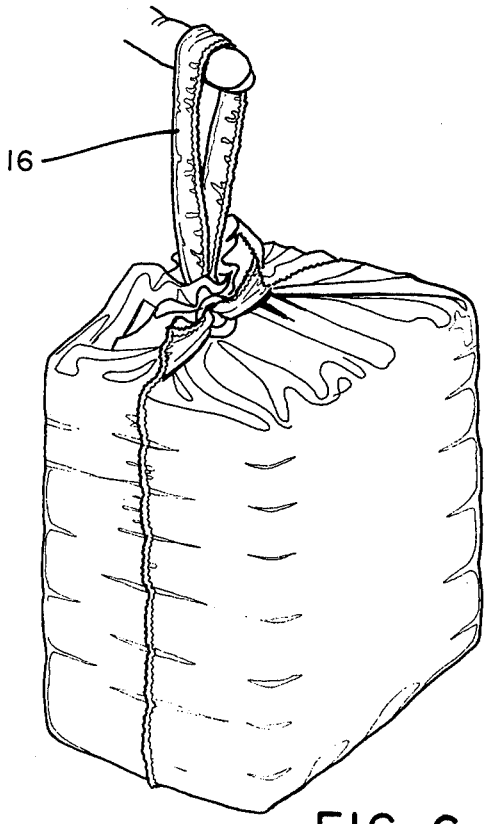

Turning to FIGS. 4, 5 and 6, use of the bag of the invention will be described. When used as a commercial container, the bag is filled with product, sealed along the edges and top, and provides a sanitary closed container. To open, a tear is made along perforation 14 as shown in FIG. 4, and the contents may be removed. To reclose, the perforated areas 22 are removed and strap 16 projected through the resulting apertures as shown in FIG. 5. The strap is pulled to tighten as shown in FIG. 6, and a closed container with a carrying grip or handle results. The reopen the container, of course, the procedure is simply reversed.

Figure 7:
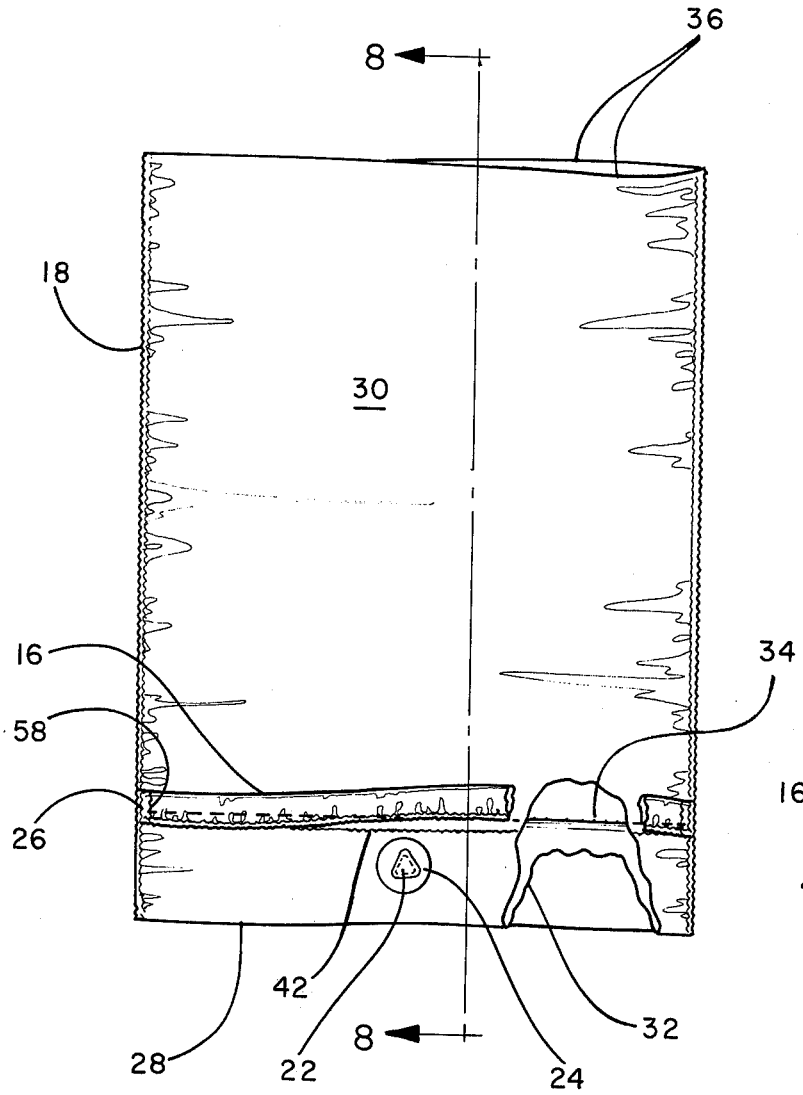
FIGS. 7 and 8 are views like FIGS. 1 and 2 showing a bag adapted to bottom loading.
Figure 8:
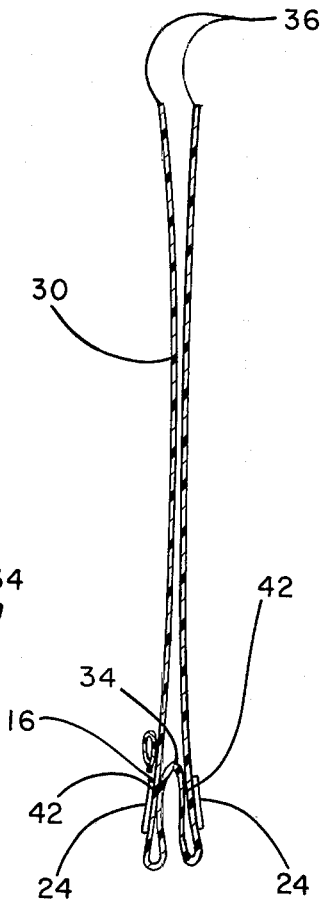
Figure 9:
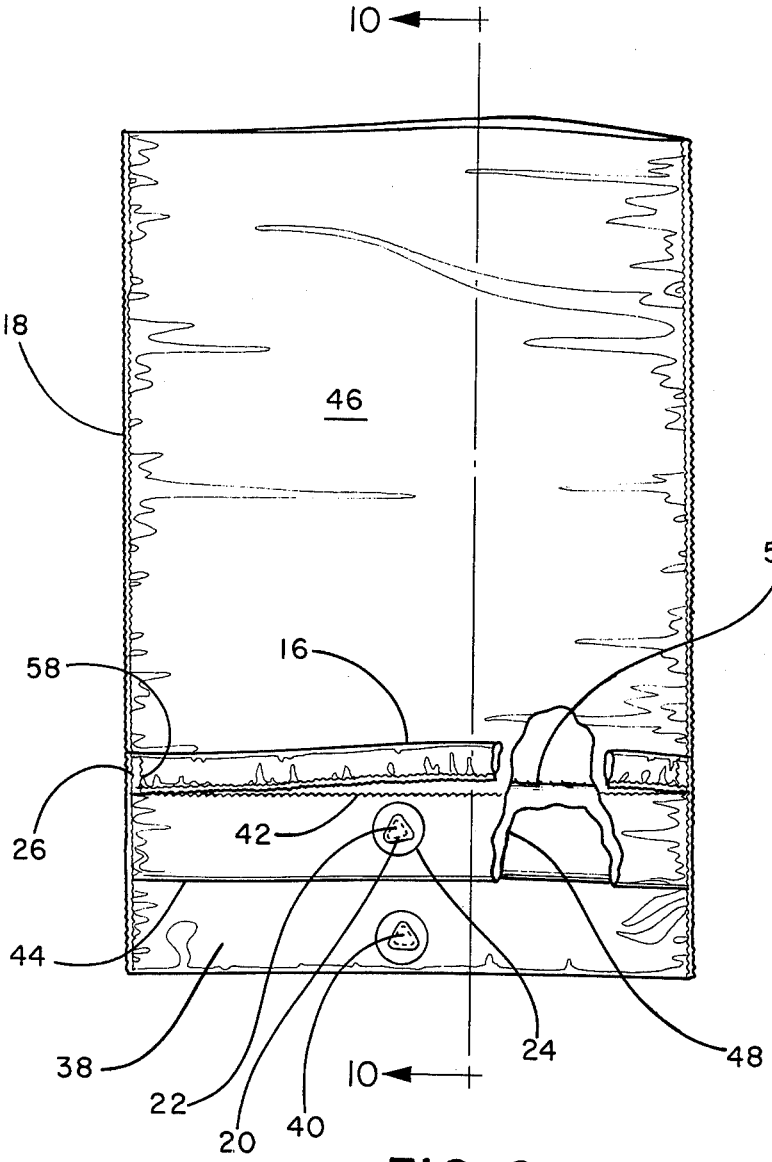
FIGS. 9 and 10 are views like FIGS. 1 and 2 showing an alternative embodiment having a flap cover.
Figure 10:
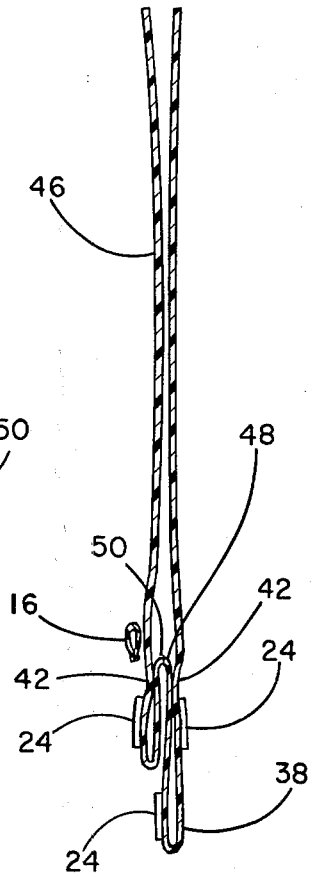

Turning to FIGS. 7 and 8, an alternative bottom loading embodiment is shown. In this case, the top 28 of bag 30 includes gusset 32 having gusset seals 42 and perf 34 along its interfold. Bottom ends 36 are left open for loading of the bag contents after which they are heat-sealed. FIGS. 9 and 10 illustrate a further embodiment having extended flap 38 including perforated area 40 positioned so as to line up with perforated area 22 when flap 38 is folded over the top 44 of the bag facing 46. In the illustrated embodiment gusset 48 is included having interperforation 50.

Figure 11:
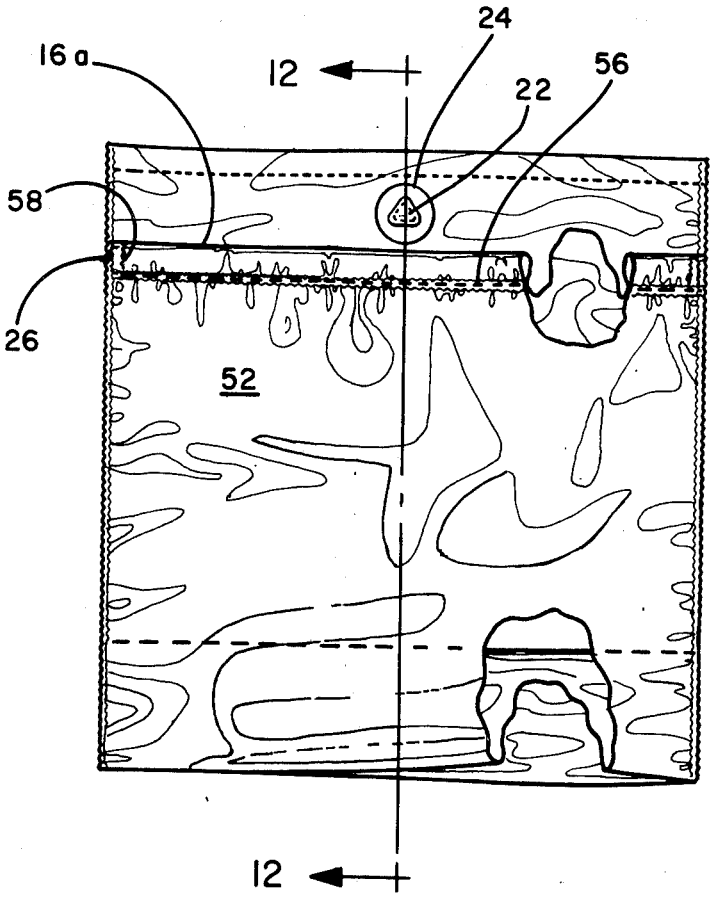
FIGS. 11 and 12 are views like FIGS. 1 and 2 illustrating an additional embodiment.
Figure 12:
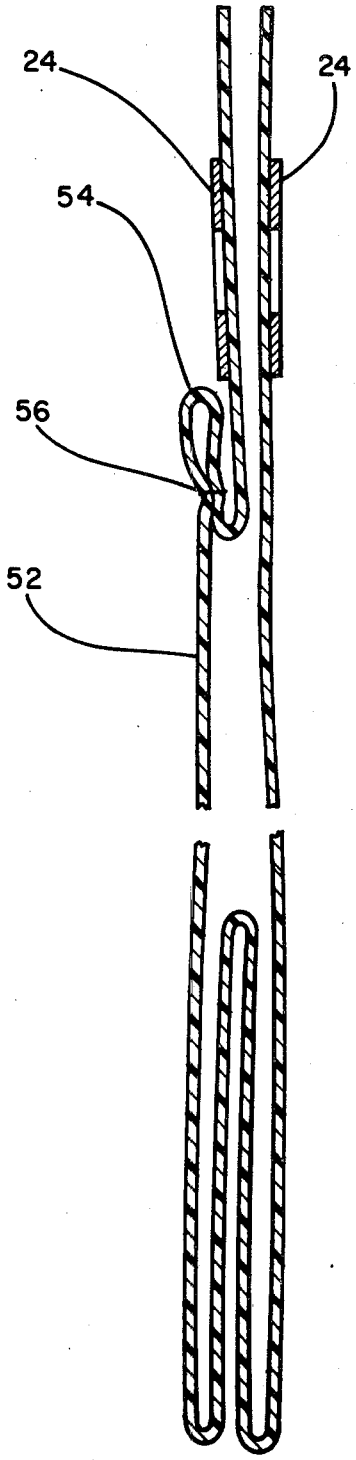

An additional embodiment is shown in FIGS. 11 and 12 wherein the strap 16A is formed from the bag sidewall, itself. As shown, the bag sidewall 52 is folded back upon itself to form loop 54 which is tacked to the sidewall by perforated hat seal line 56. When it is desired to reclose the bag, the strap 16A is pulled away tearing along line of perforations 56. Since the perforations do not extend through the sidewall 52, a closed bag may be produced by threading the strap through the reinforced aperture as with the embodiments previously described. An advantage of the structure of FIGS. 11 and 12 is that the strap is maintained close to the bag sidewall until the perforations are torn. This minimizes the tendency of the straps to become intertangled in packaging and further enhances the overall appearance of the bag.

Thus, it can be seen that the present invention provides reclosable bags of either the top loading or the bottom loading type that can be manufactured economically through the use of simple heat-sealing and perforating/punching operations. The bags of the present invention do not require the placement or threading of yarns or strings which must be subsequently knotted. Furthermore, the bags of the present invention do not require sophisticated equipment such as that which is necessary to provide heat seals over yarns or strings. In fact, it is anticipated that the bags of the present invention can be manufactured on present equipment with a minimum degree of modification. Nonetheless, the resulting bags provide highly useful containers that may be reclosed and conveniently toted through the use of the handle formed by the heat-sealed strap.

It is apparent, therefore, that there has been provided in accordance with the invention, an improved bag that fully satisfies the objects, aims, and advantages as set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

We claim:

1. A reclosable bag comprising a bottom end, sidewalls, and a top end, formed from heat-sealable material, the improvement comprising a detachable strap, wherein said strap is a looped portion of one sidewall spaced from both ends and tacked to itself along a perforated heat seal line extending laterally substantially across one full side dimension of said sidewall at a location close to said top end, and means are provided in said sidewalls adjacent the middle of said strap for projecting the strap through said sidewalls to close the top of said bag and provide a carrying handle.

2. The bag of claim 1 wherein said means for projecting the strap through said sidewalls comprises perforations adapted to be punched out to form an aperture, and further including means for reinforcing the sidewalls around the resulting apertures.

3. The bag of claim 1 further including a bottom gusset and adapted to be top loaded.

4. The bag of claim 3 further having a perforation across the top of said bag through said sidewalls to provide for easily opening of said bag.

5. The bag of claim 1 further including a top gusset and adapted to be bottom loaded.

6. The bag of claim 1 wherein the attachment of said strap to said bag sidewall is reinforced by additional heat seals.

7. The bag of claim 1 having an extended flap at the top also provided with means for forming an aperture in said flap to correspond with the apertures formed in said sidewalls when said flap is folded over the top of said bag.

* * * * *

UNITED STATES PATENT AND TRADEMARK OFFICE

CERTIFICATE OF CORRECTION

PATENT NO. : 3,982,687

DATED : September 28, 1976

INVENTOR(S) : Mary L. Auer and Richard L. Roeder

It is certified that error appears in the above-identified patent and that said Letters Patent are hereby corrected as shown below:

Column 1, line 47, "complicated" should read -- simplified --.

Column 3, line 16, "The" should read -- To --.

Column 3, line 33, "hat" should read -- heat --.

Signed and Sealed this

Seventh Day of June 1977

[SEAL]

*Attest:*

RUTH C. MASON
*Attesting Officer*

C. MARSHALL DANN
*Commissioner of Patents and Trademarks*